United States Patent [19]

Rausing

[11] Patent Number: 4,798,295

[45] Date of Patent: Jan. 17, 1989

[54] PACKING CONTAINER FOR LIQUID CONTENTS

[75] Inventor: Hans Rausing, Wadhurst Park, England

[73] Assignee: AB Tetra Pak, Lund, Sweden

[21] Appl. No.: 115,056

[22] Filed: Oct. 30, 1987

[30] Foreign Application Priority Data

Nov. 13, 1986 [GB] United Kingdom ..... 8627150

[51] Int. Cl.[4] ..... B65D 5/54

[52] U.S. Cl. ..... 206/621.6; 206/607; 206/621.3; 206/626; 229/160.2

[58] Field of Search ..... 206/607, 611, 621.3, 206/621.6, 621.7, 626, 628, 620, 633; 220/268–270; 229/125, 160.2

[56] References Cited

U.S. PATENT DOCUMENTS

| | | | |
|---|---|---|---|
| 2,312,895 | 3/1943 | Gordon | 206/607 |
| 2,555,526 | 6/1951 | Zinn, Jr. | 206/621.7 |
| 3,650,458 | 3/1972 | Rausing | 229/17 |
| 3,687,352 | 8/1972 | Kalajian | 206/626 |
| 3,836,039 | 9/1974 | Seiferth et al. | 220/270 |
| 4,101,051 | 7/1978 | Reil | 229/17 R |
| 4,113,103 | 9/1978 | Carlsson | 206/611 |
| 4,126,263 | 12/1978 | Martensson | 206/605 |
| 4,197,949 | 4/1980 | Carlsson | 206/611 |
| 4,500,011 | 2/1985 | Brochman | 220/269 |
| 4,513,876 | 4/1985 | Buchner | 220/270 |
| 4,585,498 | 4/1986 | Lagerstedt et al. | 220/359 |
| 4,595,116 | 6/1986 | Carlsson | 220/359 |

FOREIGN PATENT DOCUMENTS

| | | | |
|---|---|---|---|
| 644299 | 3/1964 | Belgium | 206/621.7 |
| 4932 | 10/1979 | European Pat. Off. | 206/626 |
| 205073 | 12/1986 | European Pat. Off. | 206/633 |
| 2099784 | 12/1982 | United Kingdom | 220/269 |

*Primary Examiner*—Stephen Marcus
*Assistant Examiner*—Gary E. Elkins
*Attorney, Agent, or Firm*—Burns, Doane, Swecker & Mathis

[57] ABSTRACT

The invention relates to a packing container which is intended for liquid contents and is of the type which comprises a container body with at least one straight side wall (1) and an upper end wall (2) which is joined to the side wall (1) along a folding line (5) so as to form a relatively sharp transition between the package side (1) and the end wall (2). The upper end wall (2) is provided with a hole (4) penetrating the package wall which preferably is of triangular shape and which with one of its points reaches up to the lateral edge (5) between the upper end wall (2) of the package and its side wall (1). The hole (4) is covered from the inside by a thin plastic film, and from the hole (4) emanate two diverging perforation lines (6) which extend up to a common crease line (7) arranged in the upper end wall (2). Over the hole (4) and parts of the perforation lines (6) a further cover strip (8) with a thermoplastic coating is provided. The cover strip (8) is sealed to the inner plastic film exposed in the hole (4) and, at least in the region between the crease lines (6), to the upper end wall (2).

6 Claims, 1 Drawing Sheet

PACKING CONTAINER FOR LIQUID CONTENTS

The present invention relates to a packing container of plastic-coated cardboard intended for liquid contents and of the type which comprises a container body with at least one straight side wall and an upper end wall which is joined to the side wall along a folding line so as to form a relatively sharp transition between the side wall and the end wall.

BACKGROUND OF THE INVENTION

It is well-known in packaging technique that non-returnable packages for liquid-filled contents are manufactured by folding of a packing material consisting plastic-coated cardboard or plastic-coated paper. Such packing containers can be manufactured from blanks prepared and punched out in advance, which are provided with crease lines facilitating the fold-forming, tearing perforations and holes for pouring openings etc. The packages can also be manufactured from a web which is rolled off from a magazine roll, and in this case too, the packing material is usually provided with crease lines facilitating the fold-forming.

The prefabricated blanks generally are converted to containers by threading them onto a mandrel with the help of which, one end wall of the packing container is formed by folding in the lugs joined to the blank over the end surface of the mandrel whereupon they are fixed by means of heat and pressure in the folded-in position so as to form a tight and firm end wall. After the forming of the end wall, the container is pulled off the mandrel, is filled with the intended contents, and is closed by folding together portions of the packing material around the open end of the blank and sealing them to one another in a tight and firm seal. The plastic layers of the packing material are thus fused together along the overlapping portions with the help of the supplied heat and compression. The packages which are manufactured from a web which is rolled off from a magazine roll are often manufactured in such a manner that the web is converted to a tube by combining the longitudinal edge zones of the web with each other and sealing them to each other. The tube is then filled with the intended contents and is divided through repeated transverse seals to form packing units which are separated by means of cuts in the sealing zones. The separated packing units subsequently can be given the desired shape, usually parallelepipedic shape, through folding along the said prepared crease lines facilitating the fold-forming.

Packing containers which are manufactured in the above-mentioned manner should be provided appropriately with an opening arrangement so that the contents can be made accessible in a convenient manner to the user of the package. Such a manner which is generally known consists in that a punched-out hole is provided in the package wall, in particular along its upper plane end surface, this hold being covered on the inside of the package wall by a thin plastic film which either constitutes a part of the unbroken inside plastic layer of the package material or a specially applied plastic strip which is sealed around the said hole against the inside layer of the packing material. To make the contents accessible to the consumer of the package the thin plastic film has to be torn up which is done with the help of an outer cover sheet or so-called pull-tab which is general consists of a relatively rigid material, e.g. paper or aluminium foil or laminate thereof and which has a plastic-coated surface. By means of pressure and heat the plastic layer of the cover strip is made to fuse together with the plastic layer which is exposed in the prepared emptying hole. When the package is to be opened the cover strip is torn off, thus causing the thin plastic film in the opening hole to be torn up and removed, since it is joined through fusion to the plastic layer of the cover strip. These known opening arrangements in principle function well, but sometimes are difficult to realize, so that there is a need for alternative opening arrangements which are simpler to manufacture and cheaper to realize. The present invention is intended to provide an indication of such an opening arrangement whose characteristics are evident from the enclosed claims.

DESCRIPTION OF THE DRAWINGS

An embodiment of the invention will be described in the following with reference to the attached schematic drawings, wherein.

DETAILED DESCRIPTION

Figure 1:
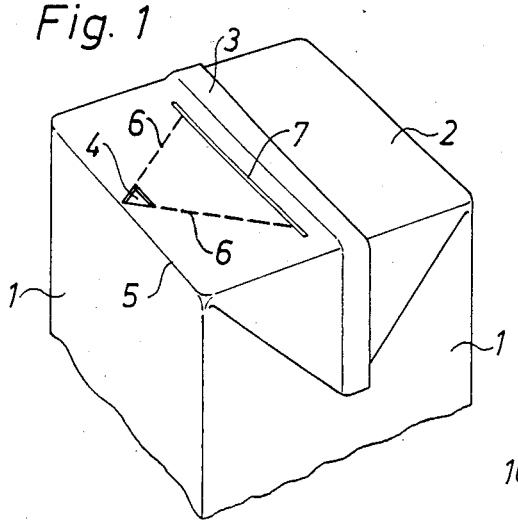
FIG. 1 is perspective view of the upper part of a packing container which is manufactured from a packing material prepared for an opening arrangement in accordance with the present invention. The packing container shown in FIG. 1, however, is not provided with any outer cover strip.

The manufacture of the packing material takes place in such a manner that a number of material layers are joined to one another, whereupon the punching of folding lines, realization of perforations etc, together with other processing operations are carried out. Usually the packing material consists of a base layer of paper or cardboard, which on the inside as well as on the outside has wholly covering layers of thermoplastic material, preferably polyethylene. In many cases a gas impermeable material is desired, and in such cases a gas impermeable layer, e.g. aluminium foil, is laminated in. As mentioned earlier, the impression of folding lines, the punching of holes and of weakening lines, e.g. perforation lines etc., are all carried out, and of course, the printing of the necessary decoration and text. In the present case it may be appropriae to punch a small, preferably triangular, hole in the laminate before the inner plastic layer is applied. The necessary perforations or weakenings too can be realized before the inner plastic layer is applied. After the folding together and forming of the packing material into a packing container, the upper part thereof acquires an appearance in accordance with FIG. 1. In this Figure the side walls of the packing container are designated 1 and its upper end wall 2. Above the upper end wall 2 extends a sealing fin 3 along which the combined panels forming the end wall are sealed together. The upper end wall 2 is provided with a small triangular hole 4 which extends up to the lateral edge 5 between the end wall 2 and one of the side walls 1 of the packing container. The punched-out hole 4 does not necessarily have to be triangular. In fact, it may be of any shape, but a part of the hole should extend up to the lateral edge 5. The hole 4 is connected to two perforation lines 6 which extend in a divergent manner from the hole 4 towards a crease line 7 in the end wall 2. As mentioned earlier, the hole 4 is covered from the inside by a thin plastic film which preferably can be constituted of the inside plastic layer of the packing material. This means that the plastic layer is exposed in the hole 4.

Figure 2:
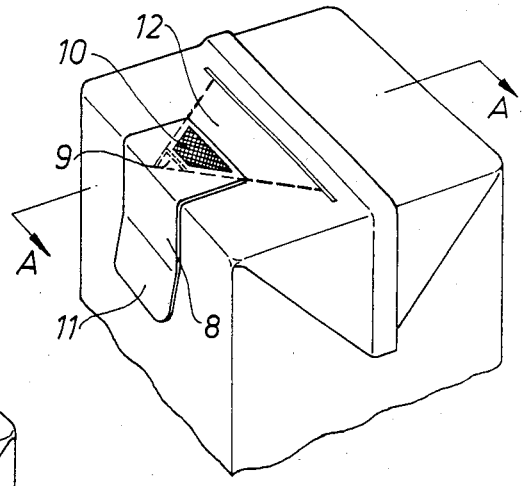
FIG. 2 is a perspective view of a cover strip attached and sealed to the package.

As mentioned previously, the package can be provided with a pull-strip 8 which is applied over the hole 4 and parts of the region between the perforation lines 6. The outer cover strip 8, which is shown in FIG. 2, is sealed in a region 9 with its inside to the plastic layer exposed in the hole 4 in such a manner that the plastic layers placed against each other are caused to fuse together. Moreover, the inside plastic layer of the cover strip 8 is sealed to the outside of the packing material in the region 10 between the said perforation lines 6. The part of the packing material which is situated between perforation or sealing lines 6, and which borders on the hole 4, advantageously may be in the shape of a tongue stretching out into the hole region 4 and being sealed to the cover strip 8.

Figure 3:
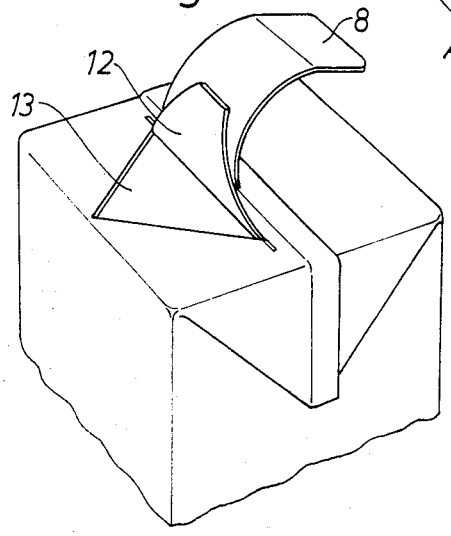
FIG. 3 is a perspective view illustrating the opening of the package.

When the package is to be opened so that the contents of the same can be made accessible, the free pull-tab 11 of the cover strip 8 is pulled upwards and in so doing the inner plastic layer within the hole 4 is torn up. When the cover strip 8 continues to be moved upwards the perforation lines or weakening lines will be subjected to stress and will break while the cover strip 8, because of the sealing joint 10, continues to be attached to the part of the upper end wall which is situated between the perforation lines 6. In FIG. 3 the region between the perforation lines or weakening lines 6 is shown torn up from the packing material belonging to the upper end wall 2, and that a lug 12 of the packing material can be removed by being folded back along the crease line 7 so that an emptying hole 13 is formed. The emptying hole 13 can be partly reclose by folding the lug 12 down again and so as to cover the emptying hole 13. The cover strip 8, which is connected to the lug 12, prevents the latter from being fully lowered into and through the emptying hole 13.

Figure 4:
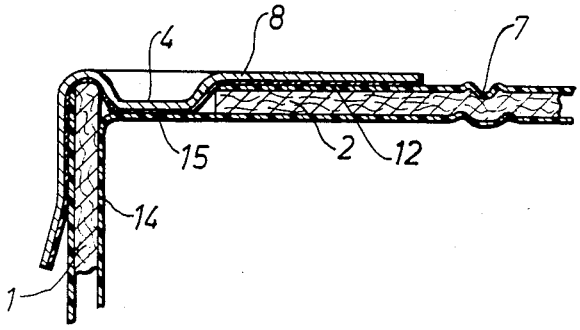
FIG. 4 is a cross-sectional view taken along line of symmetry A—A of FIG. 2.

FIG. 4 is a cross-section A—A through the packing material and it is apparent that the smaller hole 4 is situated near the top edge 5 of the side wall 1. In the hole 4, the outer cover strip 8 is placed lower so as to make contact with the inner plastic layer 14 of the packing material which is fused together with the plastic layer of the cover strip along the region 15. The inside plastic layer of the cover strip or pull-tab is also joined to the outer plastic layer of the upper end wall 2 within the region 10 so that a strong and durable joint shall be formed between the cover strip 8 and the part of the upper end wall 2 which is located between the perforation lines or weakening lines 6. In FIG. 4 it is also shown how the the crease line 7 is obtained by carrying out a linear indentation in the material. The crease line 7 functions as a pivot for the hingeable lug 12.

In thicker packing laminates the crease line 7 may be given a slightly curved shape, preferably with its convex portion facing towards the lug 12. It is the advantage of such an arrangement that the lug 12 on being raised produces stresses in the material which are such that the lug snaps over and remains in its raised position, which can be an advantage since the lug then can be moved out of the way during the pouring operation. In other words, by making the crease line 7 curved, a so-called snap-effect with a stable raised position is obtained.

It has been stated in the description that the weakening lines 6 may consist of a perforation. It is possible, however, within the framework of the concept of the invention to use other types of weakening lines, e.g., such where the material is partly punched through along two parallel cutting lines extending from both sides of the packing material. On tearing up of these, the material breaks between the "tops" of the cutting lines. In such a case the inner plastic layer 14, or a specially provided inner cover strip, should be applied after the punching of the insides of the weakening lines, especially if the packages manufactured are intended for sterile goods.

It has been found that an opening arrangement in accordance with the invention functions well and is easy and inexpensive to realize. As mentioned earlier, it is not necessary for the hole 4 to be given the shape of a triangle, but other shapes for the said hole, e.g. rhombic, square and even circular, are conceivable. It is preferable though that the hole with some part shall be situated close to the lateral edge 5 and that the perforation lines or weakening lines 6 shall connect to the contour of the hole 4 and extend in divergent manner from each other over the end wall 2. Although only preferred embodiments are specifically illustrated and described herein, it will be appreciated that many modifications and variations of the present invention are possible in light of the above teachings and within the purview of the appended claims without departing from the spirit and intended scope of the invention.

I claim:

1. A packing container for liquid contents manufactured of a packing material of plastic-coated cardboard and which comprises:

a container body with an inside and at least one straight side wall and an upper end wall which is joined to the side wall along a folding line so as to form a relatively sharp transition between the package side wall and the upper end wall;

a hole arranged in the upper end wall, which hole extends up to the folding line;

two weakening lines which extend from opposite edges of the hole in divergent directions over the upper end wall of the packing container up to a crease line in the upper end wall;

the hole is covered from the inside of the package by a thin thermoplastic film which constitutes the inner plastic coating of the packing material;

a cover strip is arranged over the hole and at least over parts of the upper end wall between the weakening lines and which cover strip is sealed to the thermoplastic film exposed in the hole and to the outside of the upper end wall between the weakening lines.

2. The packing container in accordance with claim 1, wherein the hole is arranged along one side of the folding line.

3. A packing container for liquid contents manufactured of a packing material of plastic-coated cardboard and which comprises:

a container body with an inside and at least one straight side wall and an upper end wall which is joined to the side wall along a folding line so as to form a relatively sharp transition between the package side wall and the upper end wall;

a hole arranged in the upper end wall, which hole extends up to the folding line;

two weakening lines which extend from opposite edges of the hole in divergent directions over the upper end wall of the packing container up to a crease line in the upper end wall;

the hole being covered from the inside of the package by a thin thermoplastic film which constitutes the inner plastic coating of the packing material;

a cover strip arranged over the hole and at least over parts of the upper end wall between the weakening lines and which cover strip is sealed to the thermoplastic film exposed in the hole and to the outside of the upper end wall between the weakening lines;

wherein the crease line in the upper end wall is of a curved shape with a convex side facing towards a region between the weakening lines.

4. A packing container for liquid contents manufactured of a packing material of plastic-coated cardboard and which comprises:

a container body with an inside and at least one straight side wall and an upper end wall which is joined to the side wall along a folding line so as to form a relatively sharp transition between the package side wall and the upper end wall;

a hole arranged in the upper end wall, which hole extends up to the folding line;

two weakening lines which extend from opposite edges of the hole in divergent directions over the upper end wall of the packing container up to a crease line in the upper end wall;

the hole being covered from the inside of the package by a thin thermoplastic film specially provided and heat-sealed around the hole;

a cover strip arranged over the hole and at least over parts of the upper end wall between the weakening lines and which cover strip is sealed to the thermoplastic film exposed in the hole and to the outside of the upper end wall between the weakening lines.

5. The packing container in accordance with claim 4, wherein the hole is arranged along one side of the folding line.

6. The packing container in accordance with claim 4, wherein the crease line in the upper end wall is of a curved shape with a convex side facing towards a region between the weakening lines.

* * * * *